US006147587A

United States Patent [19]

Hadano et al.

[11] Patent Number: 6,147,587

[45] Date of Patent: Nov. 14, 2000

[54] LAMINATED-TYPE VARISTOR

[75] Inventors: Kenjiro Hadano; Tsuyoshi Kawada; Iwao Fukutani; Kazutaka Nakamura; Kuzuhiro Kaneko; Ryouichi Urahara, all of Kyoto-fu, Japan

[73] Assignee: Murata Manufacturing Co., Ltd., Japan

[21] Appl. No.: 09/219,616

[22] Filed: Dec. 23, 1998

[30] Foreign Application Priority Data

Dec. 25, 1997 [JP] Japan ..... 9-367998

[51] Int. Cl.[7] ..... H01C 7/10

[52] U.S. Cl. ..... 338/21; 338/314

[58] Field of Search ..... 338/20, 21, 307, 338/308, 314, 273, 332; 361/321, 117, 121

[56] References Cited

U.S. PATENT DOCUMENTS 5,119,062 6/1992 Nakamura et al. ..... 338/20
5,155,464 10/1992 Cowman et al. ..... 338/21
5,412,357 5/1995 Nakamura et al. ..... 333/181
5,757,263 5/1998 Ravindranathan ..... 338/21

FOREIGN PATENT DOCUMENTS 5-299201 11/1993 Japan .

*Primary Examiner*—Lincoln Donovan
*Assistant Examiner*—Richard K. Lee
*Attorney, Agent, or Firm*—Ostrolenk, Faber, Gerb & Soffen, LLP

[57] ABSTRACT

A laminated-type varistor includes a laminated structure and a pair of external electrodes disposed on a surface of the laminated structure. The laminated structure includes effective sintered body layers and internal electrodes. The internal electrodes are connected to the external electrodes and are disposed apart from each other in the direction perpendicular to lamination surfaces. Each of the internal electrodes has a multilayer electrode structure in which a plurality of electrode layers are arranged in layers while an ineffective sintered body layer is disposed therebetween. The laminated-type varistor has increased maximum peak current and maximum energy and reduction in clamping voltage.

18 Claims, 11 Drawing Sheets

FIG. 18

| | LAMINATED-TYPE VARISTOR OF EMBODIMENT 3 | LAMINATED-TYPE VARISTOR OF COMPARATIVE EMBODIMENT 1 |
|---|---|---|
| MAXIMUM PEAK CURRENT | 1610A | 1406A |
| MAXIMUM ENERGY | 23.1J | 21.4J |
| CLAMPING VOLTAGE | 580V | 592V |

LAMINATED-TYPE VARISTOR

BACKGROUND OF THE INVENTION

1. Field of the Invention

The present invention relates to a laminated-type varistor, and particularly to a laminated-type varistor having an increased maximum peak current, an increased maximum energy, and a reduced clamping voltage.

2. Related Art

As shown in FIG. 17A, a laminated-type varistor 40, which is of a chip type and can be surface-mounted, usually comprises a laminated structure 41 and a pair of external electrodes 44*a* and 44*b* disposed on a surface of the laminated structure 41. The laminated structure 41 consists of effective sintered body layers 42, each of which provides varistor characteristics, and a plurality of internal electrodes 43*a* and 43*b*, which have a higher heat conductivity than do the effective sintered body layers 42 (see Japanese Patent Application Laid-Open (kokai) No. 54-106894.)

The laminated-type varistor 40 has been widely used, for example, as a surge-absorbing element, because of its nonlinear resistance characteristics (the varistor characteristics); i.e. when a voltage higher than a predetermined threshold is applied to the effective sintered body layer 42 via the external electrodes 44*a* and 44*b* and the internal electrodes 43*a* and 43*b*, the value of resistance of the effective sintered body layer 42 decreases considerably.

However, the laminated-type varistor described above does not have a sufficient maximum peak current or a sufficient maximum energy, and has a high contact resistance between the internal and external electrodes (connection resistance).

In addition, such a conventional laminated-type varistor releases less heat at its center portion than at the vicinity of the surface, and thus has low maximum peak current and maximum energy. Accordingly, such a varistor is easily broken due to heat generated by surge absorption. Further, since the contact resistance (connection resistance) between the internal electrodes and the external electrodes is high and therefore the clamping voltage at the time of surge absorption is high, the surge-absorbing action is not sufficient.

There has been proposed a laminated-type varistor 45 as shown in FIG. 17B, which comprises an ineffective sintered body layer 46 (a sintered body layer that is not associated with the varistor characteristics) that is thicker than an effective sintered body layer exercising the varistor characteristics and is disposed in the laminated structure (see Japanese Patent Application Laid-Open (kokai) No. 8-153606.) Since no surge-absorbing current passes through the ineffective sintered body layer 46 disposed in the laminated structure, heat is not generated due to surge absorption, and the ineffective sintered body layer serves as a heat sink layer. Accordingly, the laminated-type varistor 45 is endowed with an increased maximum peak current and an increased maximum energy.

However, the laminated-type varistor 45 still has drawbacks in that its heat-releasing property has not been sufficiently improved, its maximum peak current and maximum energy have not been sufficiently increased, and the contact resistance between the internal and external electrodes has not been decreased, so that the clamping voltage at the time of surge absorption is still high.

Another possible solution is thickening of the internal electrodes, to thereby improve their function as a heat radiation path and increase the maximum peak current and maximum energy of the varistor, and increasing of a contact area of the internal and external electrodes, to thereby reduce the contact resistance and the clamping voltage at surge absorption in order to decrease the clamping voltage at the time of surge absorption.

However, thickening of the internal electrodes has drawbacks in that the laminated structure is subject to delamination, resulting in failure to secure desired reliability.

SUMMARY OF THE INVENTION

In view of the foregoing, an object of the present invention is to provide a laminated-type varistor having an increased maximum peak current, an increased maximum energy, and a reduced clamping voltage.

To achieve the above object, the present invention provides a laminated-type varistor comprising a laminated structure and a pair of external electrodes disposed on a surface of the laminated structure. The laminated structure comprises a plurality of effective sintered body layers, each of which exhibits varistor characteristics, and a plurality of internal electrodes, each having thermal conductivity higher than that of the effective sintered body layer. Of the plurality of internal electrodes, at least two of the internal electrodes connected to the external electrode and disposed apart from each other in a direction perpendicular to lamination surfaces have a multilayer electrode structure in which a plurality of electrode layers are arranged while an ineffective sintered body layer not contributing to varistor characteristics is disposed therebetween.

In the laminated-type varistor of the present invention, heat which is generated in the effective sintered body layer during surge absorption is promptly discharged to the exterior of the varistor without any nonuniform heat radiation through the internal electrodes, each having the multilayer electrode structure, which are disposed apart from each other in the laminated structure in the direction perpendicular to lamination surfaces. Accordingly, heat radiation and thermal shock resistance are improved, and thus the maximum peak current and the maximum energy can be sufficiently enhanced.

Also, in the laminated-type varistor of the present invention, since each of the internal electrodes is in contact with the external electrode at a plurality of positions, the area of contact between the internal electrodes and the external electrodes is increased as compared to the case of a conventional laminated-type varistor, and thus the contact resistance between the internal electrodes and the external electrodes can be reduced, thereby reducing a clamping voltage during surge absorption.

Further, in the laminated-type varistor of the present invention, each of the internal electrodes is divided into a plurality of electrode layers in the thickness direction thereof while the ineffective sintered body layer is interposed between the electrode layers, thereby avoiding the presence of thick electrode layers within the laminated structure and thus preventing the occurrence of delamination within the laminated structure. Thus, the maximum peak current and the maximum energy can be enhanced, and also a clamping voltage during surge absorption can be reduced.

Preferably, of the plurality of internal electrodes, a top internal electrode and a bottom internal electrode each have a single-layer electrode structure.

In this case, employment of the single-layer electrode structure enables simplification of a manufacturing process without having much adverse effect on heat radiation, because the top or bottom internal electrode is located in the vicinity of a surface of the laminated-type varistor.

Preferably, an internal electrode connected to one external electrode and an internal electrode connected to the other external electrode are disposed on the same plane such that unconnected ends thereof face each other a predetermined distance away. A floating internal electrode not connected to the external electrodes is disposed apart from the internal electrodes connected to the external electrodes, via an effective sintered body layer. Thus is formed a multistage varistor. The floating internal electrode is an unexposed electrode, which is not exposed on the end surfaces of the laminated structure.

In this case, since sintered body layers are bonded to each other in the region located between the internal electrodes where the internal electrodes are separated from each other and since sintered body layers are bonded to each other in the region located around the periphery of the floating internal electrode where no electrode is formed, the anti-breakage strength of the laminated structure is improved. Accordingly, the maximum peak current and the maximum energy can be further enhanced. Also, since an electric field is established bidirectionally in the effective sintered body layer, the maximum peak current and the maximum energy can be further enhanced.

Preferably, the thickness of the ineffective sintered body layer is not greater than that of the effective sintered body layer.

In this case, since the distance between the effective sintered body layer and the electrode layers of the internal electrode becomes short, the electrode layers, through which heat generated in the effective sintered body layer is released, are brought close to the effective sintered body layer. Thus, heat radiation can be enhanced. As a result, the maximum peak current and the maximum energy can be further enhanced. By limiting the thickness of the ineffective sintered body layer to not greater than the thickness of the effective sintered body layer, there can be suppressed an increase in the thickness of the laminated-type varistor which would otherwise result from employment of the multilayer electrode structure.

More preferably, the thickness of the ineffective sintered body layer is not greater than ¼ that of the effective sintered body layer.

In this case, since the distance between the effective sintered body layer and the electrode layers of the internal electrode becomes very short, the electrode layers, through which heat generated in the effective sintered body layer is released, are brought closer to the effective sintered body layer. Thus, heat radiation can be further enhanced. As a result, the maximum peak current and the maximum energy can be far more enhanced. By limiting the thickness of the ineffective sintered body layer to not greater than ¼ the thickness of the effective sintered body layer, there can be more effectively suppressed an increase in the thickness of the laminated-type varistor which would otherwise result from employment of the multilayer electrode structure.

BRIEF DESCRIPTION OF THE DRAWINGS

FIG. 18 shows comparative results obtained by Embodiment 1 and Embodiment 3.

PREFERRED EMBODIMENTS

Embodiments of the present invention will now be described with reference to the accompanying drawings.

EMBODIMENT 1

Figure 1:
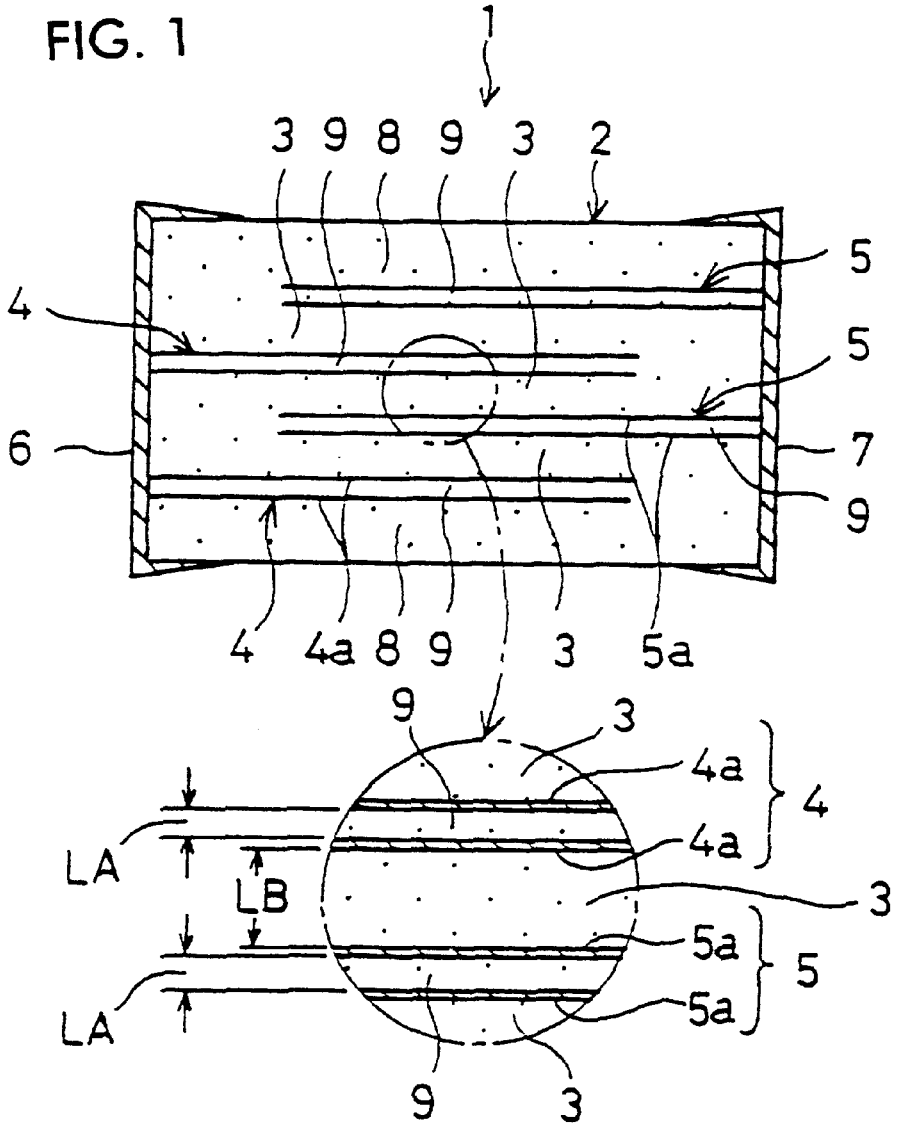
FIG. 1 is a sectional view showing a laminated-type varistor according to an embodiment (Embodiment 1) of the present invention.
Figure 2:
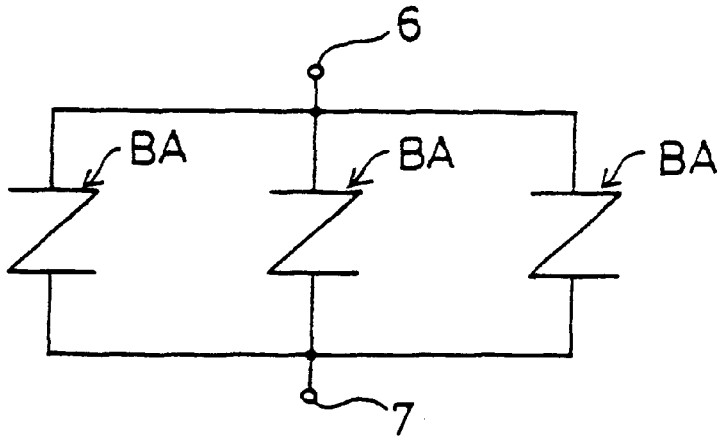
FIG. 2 is an equivalent circuit diagram of the laminated-type varistor according to Embodiment 1.

FIG. 1 is a section view of a laminated-type varistor according to the present embodiment. FIG. 2 is an equivalent circuit view of the laminated-type varistor according to the present embodiment.

As shown in FIG. 1, the laminated-type varistor 1 is a chip-type varistor comprising a laminated structure 2 and a pair of external electrodes 6 and 7 disposed on a surface of the laminated structure 2. The laminated structure 2 consists of effective sintered body layers 3, each of which exhibits the varistor characteristics, and four internal electrodes 4 and 5, which have a larger heat conductivity than the effective sintered body layer 3.

The two internal electrodes 4 of the laminated-type varistor 1 are connected to an external electrode 6, and the other two internal electrodes 5 are connected to the other external electrode 7. The voltage applied between the external electrodes 6 and 7 is then applied to each of the effective sintered body layers 3 via the internal electrodes 4 and 5. Protective layers 8 (ceramic layers) are provided on the top and bottom of the laminated structure 2.

Accordingly, in the laminated-type varistor 1, a single varistor structure is formed for each effective sintered body layer 3. That is, as shown in FIG. 2, the laminated-type varistor 1 is equivalent to three varistor elements BA connected in parallel. In the present embodiment, the effective sintered body layer 3 is formed through use of a ZnO sintered body. Notably, the effective sintered body layer 3 may also be formed through use of an $SrTiO_3$ sintered body or any other appropriate material.

In the laminated-type varistor 1, the internal electrode 4 (5) has a two-layer electrode structure in which two electrode layers 4*a* (5*a*) are disposed facing each other while an ineffective sintered body layer 9 is disposed therebetween. Accordingly, in a laminated structure 2 of the present embodiment, four two-layer electrode structures are disposed apart from each other in the direction perpendicular to lamination surfaces. Each varistor-function unit includes two-layer electrode structures. In the present embodiment, the electrode layers 4*a* and 5*a* of the internal electrodes 4 and 5, respectively, are formed through use of a Pt alloy, an Ag—Pd alloy, or an Ni alloy. The electrode layers 4*a* and 5*a* may be formed through use of any other appropriate material.

As in the case of the effective sintered body layer 3, the ineffective sintered body layer 9 is formed through use of a ZnO sintered body. However, the ineffective sintered body layer 9 may be formed through use of an $SrTiO_3$ sintered body or any other appropriate material. The material (sintered body) of the ineffective sintered body layer 9 may be identical to or different from that of the effective sintered body layer 3.

In the laminated-type varistor 1, a thickness LA of the ineffective sintered body layer 9 is about ¼ a thickness LB of the effective sintered body layer 3.

Next will be described a surge-absorbing action of the laminated-type varistor 1.

A surge voltage which has reached the external electrodes 6 and 7 is applied to each of the effective sintered body electrodes 3 via the internal electrodes 4 and 5. When the voltage applied to the effective sintered body layers 3 exceed a predetermined threshold, the resistance of the effective sintered body layers 3 abruptly drops because of varistor characteristics thereof. At the same time, a large current flows through the effective sintered body layers 3, thereby absorbing surge.

Meanwhile, since no voltage is applied to the ineffective sintered body layers 9, the ineffective sintered body layers 9 do not exhibit a surge-absorbing function. Thus, no current flows through the ineffective sintered body layers 9 even during surge absorption.

In the laminated-type varistor 1, heat which is generated in the effective sintered body layers 3 during surge absorption is quickly and uniformly discharged to the exterior of the laminated structure 2 via four internal electrodes 4 and 5, each having the two-layer electrode structure, which are disposed apart from each other in the laminated structure 2. Accordingly, the maximum peak current and the maximum energy of the laminated-type varistor 1 are enhanced. Further, since two electrode layers 4*a* (5*a*) which constitute the internal electrode 4 (5) are in contact with the external electrodes 6 and 7, a contact resistance between the internal electrodes 4 and 5 and the external electrodes 6 and 7 is decreased, thereby decreasing a clamping voltage at surge absorption. Also, through increase in the number of contact positions between the internal electrodes 4 and 5 and the external electrodes 6 and 7, the reliability of connection between the internal electrodes 4 and 5 and the external electrodes 6 and 7 is improved. Additionally, each of the internal electrodes 4 and 5 is divided into two electrode layers in the thickness direction thereof while the ineffective sintered body layer 9 is interposed between the electrode layers, thereby avoiding the presence of thick electrode layers within the laminated structure 2 and thus efficiently preventing the occurrence of delamination within the laminated structure 2.

Further, in the laminated-type varistor 1, since the thickness of the ineffective sintered body layer 9 is ¼ that of the effective sintered body layer 3, the electrode layers 4*a* and 5*a,* through which heat generated in the effective sintered body layer 3 is released, are located in the proximity of the effective sintered body layers 3. Thus, the maximum peak current and the maximum energy of the laminated-type varistor 1 are further enhanced.

Since the ineffective sintered body layer 9 is thin, there can be effectively suppressed an increase in the thickness of the laminated-type varistor 1 which would otherwise result from employment of the two-layer electrode structure.

Also, in the laminated-type varistor 1, since the effective sintered body layer 3 is formed through use of a ZnO sintered body, excellent varistor characteristics can be obtained. Since the electrode layers 4*a* and 5*a* are formed through use of a Pt alloy, which exhibit excellent thermal conductivity, heat generated in the effective sintered body layers 3 can be more quickly discharged to the exterior of the laminated-type varistor 1. Thus, the maximum peak current and the maximum energy of the laminated-type varistor 1 can be greatly enhanced.

The above present embodiment is described while mentioning the internal electrodes 4 and 5, each having the two-layer electrode structure. However, for example, as shown in FIG. 3, only predetermined internal electrodes 4 and 5 located in a central portion as viewed along the direction of lamination may be of the two-layer electrode structure, whereas other internal electrodes 4A and 5A may be of a single-layer electrode structure.

Figure 3:
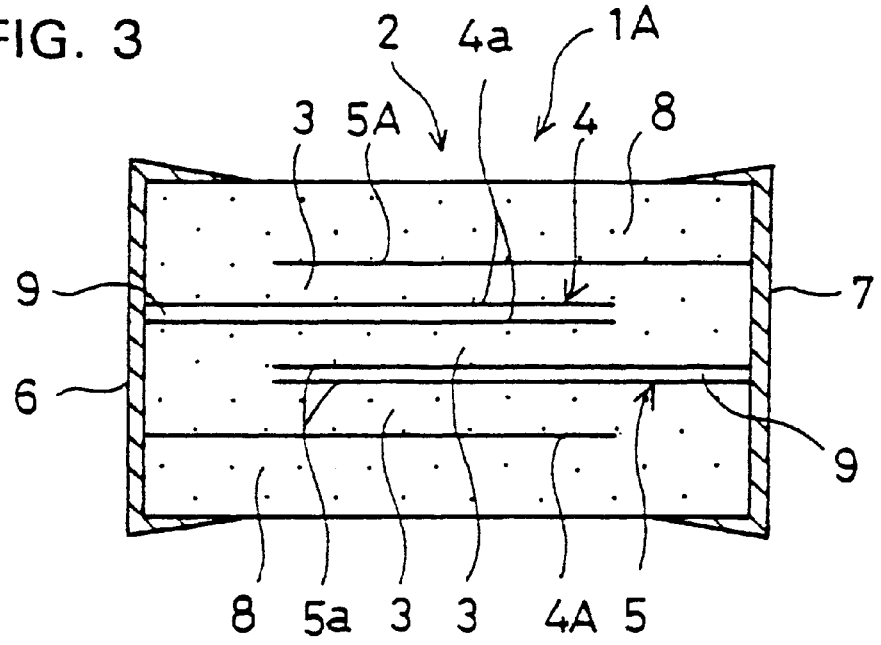
FIG. 3 is a sectional view showing a modification of the laminated-type varistor of Embodiment 1.

Further, in FIG. 3, either the internal electrode 4 or the internal electrode 5 may be of the two-layer electrode structure.

Figure 4:
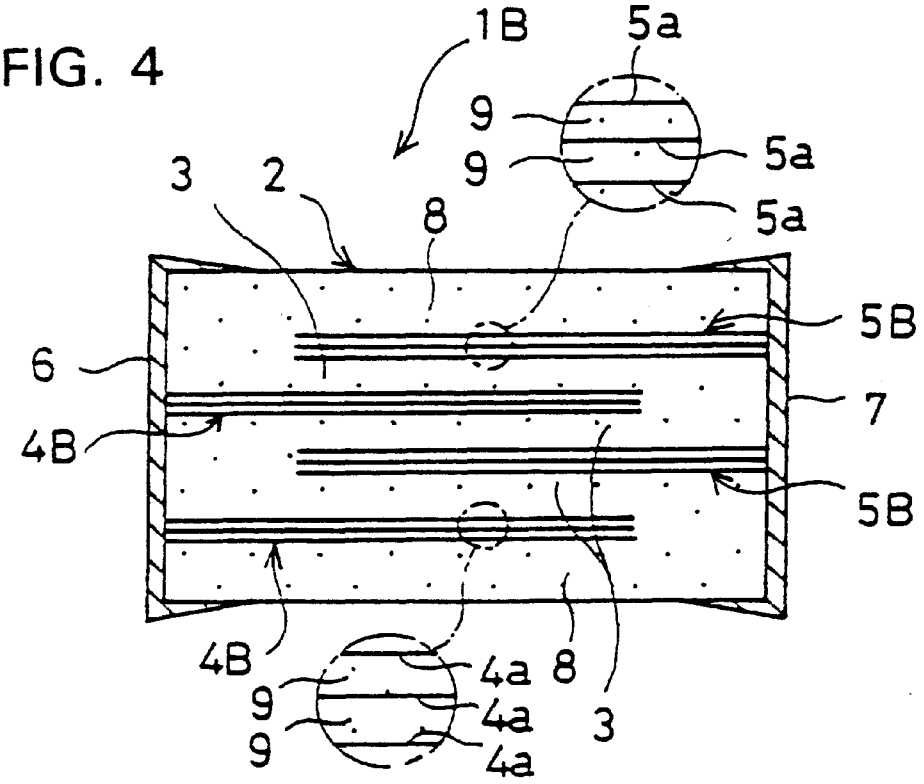
FIG. 4 is a sectional view showing another modification of the laminated-type varistor of Embodiment 1.

The above present embodiment is described while mentioning the internal electrodes 4 and 5, each having the two-layer electrode structure. However, as shown in FIG. 4, the present invention includes a laminated-type varistor 1B in which internal electrodes 4B and 5B of a three-layer electrode structure are disposed. Because of an increase in the number of electrode layers and ineffective sintered body layers, the laminated-type varistor 1B exhibits further improved heat radiation. Notably, in the present invention, each internal electrode may have a multilayer structure of four more layers.

EMBODIMENT 2

Figure 5:
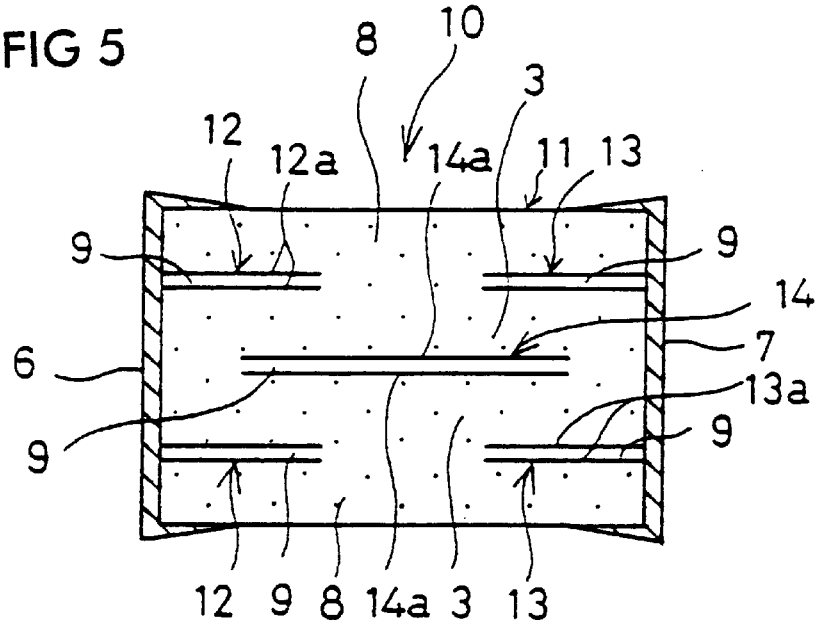
FIG. 5 is a sectional view showing a laminated-type varistor according to another embodiment (Embodiment 2) of the present invention.
Figure 6:
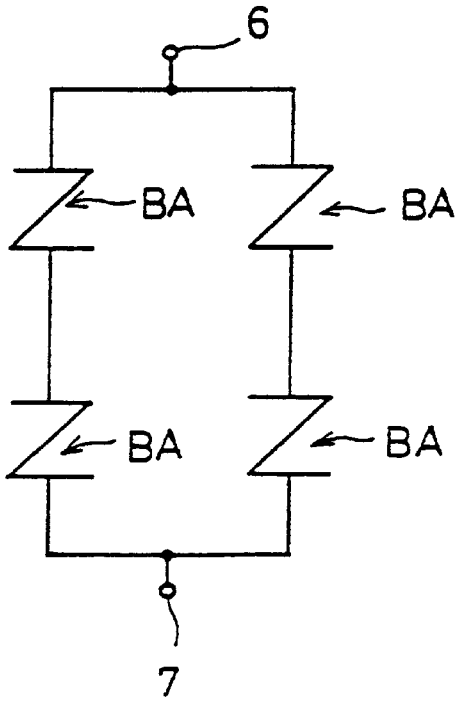
FIG. 6 is an equivalent circuit diagram of the laminated-type varistor according to Embodiment 2.

Next will be described a laminated-type varistor according to another embodiment of the present invention. FIG. 5 is a sectional view showing a laminated-type varistor of Embodiment 2. FIG. 6 is an equivalent circuit diagram of the laminated-type varistor of Embodiment 2.

A laminated-type varistor 10 (FIG. 5) has a structure and effects similar to those of Embodiment 1 except for a two-stage varistor structure. In order to avoid redundant description, only different features will be described, while the description of similar features is omitted.

In the laminated-type varistor 10, an internal electrode 12 connected to one external electrode 6 and an internal electrode 13 connected to the other external electrode 7 are disposed on the same plane such that unconnected ends thereof face each other a predetermined distance away. A floating internal electrode 14 is disposed apart from the internal electrodes 12 and 13 via the effective sintered body layer 3. Thus, as shown in FIG. 6, a two-stage varistor is configured. The periphery of the floating internal electrode 14 recedes a predetermined distance from an end surface of a laminated structure 11, i.e., the floating internal electrode 14 is an unexposed electrode.

The internal electrode 12 (13) has a two-layer electrode structure composed of electrode layers 12*a* (13*a*) with the ineffective sintered body layer 9 interposed therebetween. In Embodiment 2, two two-layer electrode structures are disposed within the laminated structure 11 in a separated manner in the direction perpendicular to lamination surfaces, thereby enabling sufficient heat radiation from the laminated structure 11. Also, the floating internal electrode 14 has a two-layer electrode structure composed of electrode layers 14*a* with the ineffective sintered body layer 9 interposed therebetween.

In the case of the laminated-type varistor 10, in the laminated structure 11, no electrode is formed in a region between the internal electrodes 12 and 13, so that sintered body layers are bonded to each other in the region. Also, no electrode is formed in a region between the periphery of the floating internal electrode 14 and an end surface of the laminated structure 11, and sintered body layers are bonded to each other in the region. Thus, the anti-breakage strength of the laminated structure 11 is improved.

In the case of the laminated-type varistor 10, when current flows from the internal electrode 12 to the internal electrode 13 or from the internal electrode 13 to the internal electrode 12 during surge absorption, the current flows through the floating internal electrode 14. Thus, the current reciprocates along the thickness direction of the effective sintered body layer 3. Accordingly, a single varistor structure is formed between each effective sintered body layer 3 and each internal electrode 12 and between each effective sintered body layer 3 and each internal electrode 13. In other words, as shown in FIG. 6, two two-stage varistor configurations, each composed of two varistor elements BA which are connected in series, are connected in parallel.

Since the laminated structure 11 has a high anti-breakage strength, the laminated-type varistor 10 can be further enhanced in maximum peak current and maximum energy.

Also, when the laminated-type varistor 10 is undergoing a surge-absorbing action, an electric field is established bidirectionally in the effective sintered body layer 3. As compared to the case where an electric field is established unidirectionally in the effective sintered body layer 3, the maximum peak current and the maximum energy can be more enhanced.

Figure 7:
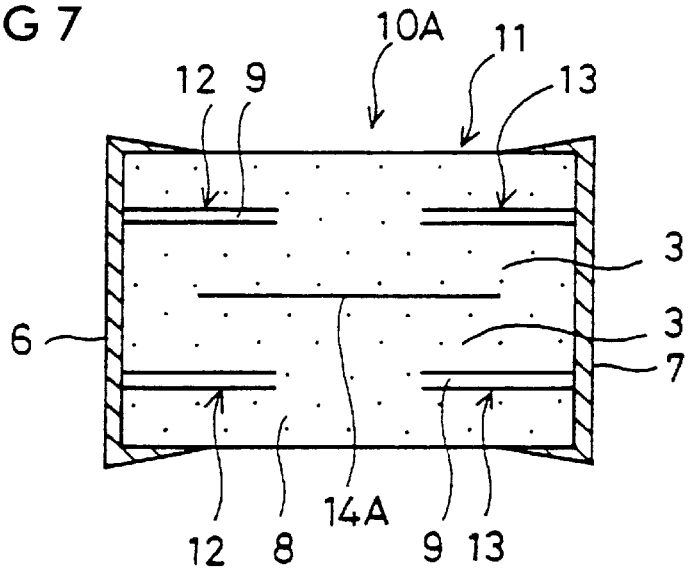
FIG. 7 is a sectional view showing a modification of the laminated-type varistor of Embodiment 2.

In the laminated-type varistor 10 of Embodiment 2, each of the internal electrodes 12 and 13 and the floating internal electrode 14 has the two-layer electrode structure. However, as shown in FIG. 7, the laminated-type varistor 10 of Embodiment 2 may be modified to a laminated-type varistor 10A in which only a floating internal electrode 14A is of a single-layer electrode structure.

Figure 8:
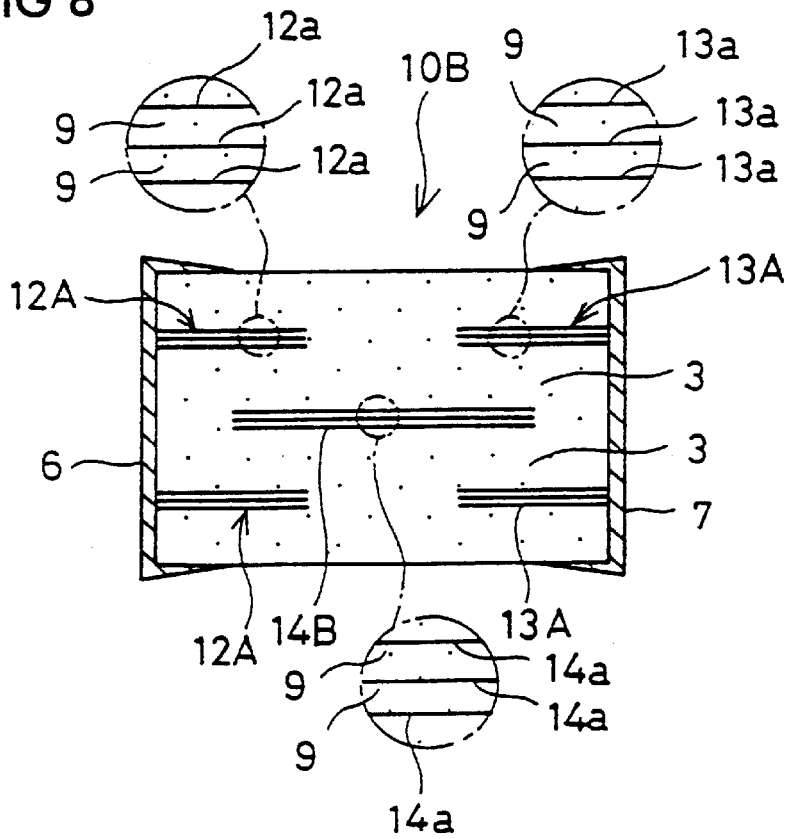
FIG. 8 is a sectional view showing another modification of the laminated-type varistor of Embodiment 2.

Also, as shown in FIG. 8, the laminated-type varistor 10 of Embodiment 2 may be modified to a laminated-type varistor 10B in which internal electrodes 12A and 13A and a floating internal electrode 14B are of a three-layer electrode structure.

EMBODIMENT 3

Figure 9:
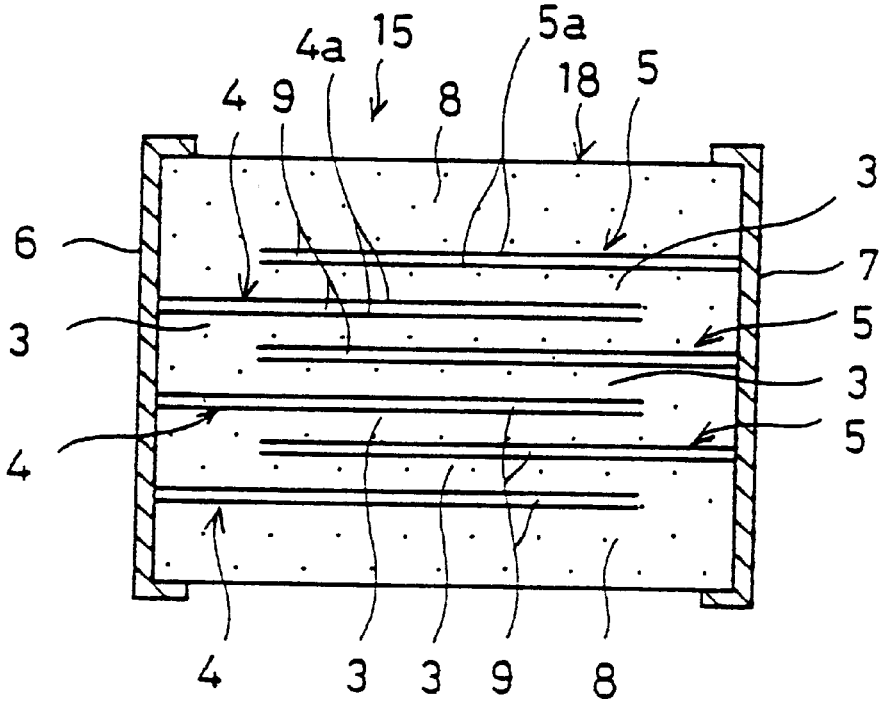
FIG. 9 is a sectional view showing a laminated-type varistor according to still another embodiment (Embodiment 3) of the present invention.

Next will be described a laminated-type varistor according to a further embodiment of the present invention. FIG. 9 is a sectional view showing a laminated-type varistor of Embodiment 3.

A laminated-type varistor 15 of Embodiment 3 has a structure and effects similar to those of Embodiment 1 except that the varistor structure has two more laminae and that the thickness of the ineffective sintered body layer 9 is about ⅙ that of the effective sintered body layer 3. In order to avoid redundant description, the description of the structure and effects will be omitted.

A method for manufacturing the laminated-type varistor 15 of Embodiment 3 will be described specifically.

98.6 mol % of ZnO material having a purity of not less than 99%, 0.3 mol % of $Bi_2O_3$, 0.5 mol % of $CoCO_3$, 0.5 mol % of $MnO_2$, and 0.1 mol % of $Sb_2O_3$ were prepared by weighing, followed by addition of pure water and balls. The resulting mixture was mixed and pulverized for 24 hours through use of a ball mill, obtaining slurry.

The thus-obtained slurry was filtrated and dried, followed by granulation. To the resulting grains were added pure water and balls. The resulting mixture was finely pulverized, obtaining slurry. The obtained slurry was filtrated and dried.

To the thus-obtained filtrated dried substance were added a binder and organic solvents (ethyl alcohol and toluene) and then a dispersant. The resulting mixture was pulverized through use of a ball mill, obtaining slurry.

The thus-obtained slurry was sheeted through doctor blading to obtain a sheet having a thickness of 50 :m. The sheet was subjected to blanking to obtain rectangular ceramic green sheets having a predetermined size.

Figure 10:
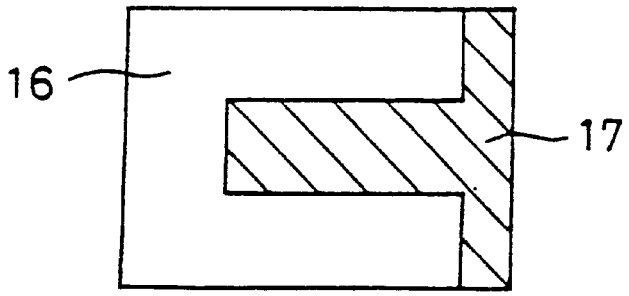
FIG. 10 is a plan view showing a pattern-printed green sheet used for manufacture of the laminated-type varistor according to Embodiment 3.

Next, as shown in FIG. 10, a pattern 17 was formed on a surface of the green sheet 16. The pattern 17 serves as an electrode layer 4*a* (5*a*) which constitutes the internal electrode 4 (5). The pattern 17 was formed through screen printing of a Pt paste which contains Pt in an amount of 70% by weight. An edge of the pattern 17 to be connected with the external electrode 6 (7) was made to reach an edge of the green sheet 16, whereas three other edges of the pattern 17 were made not to reach an edge of the green sheet 16 so as to form a gap between each of the three edges of the pattern 17 and the edge of the green sheet 16.

Figure 11:
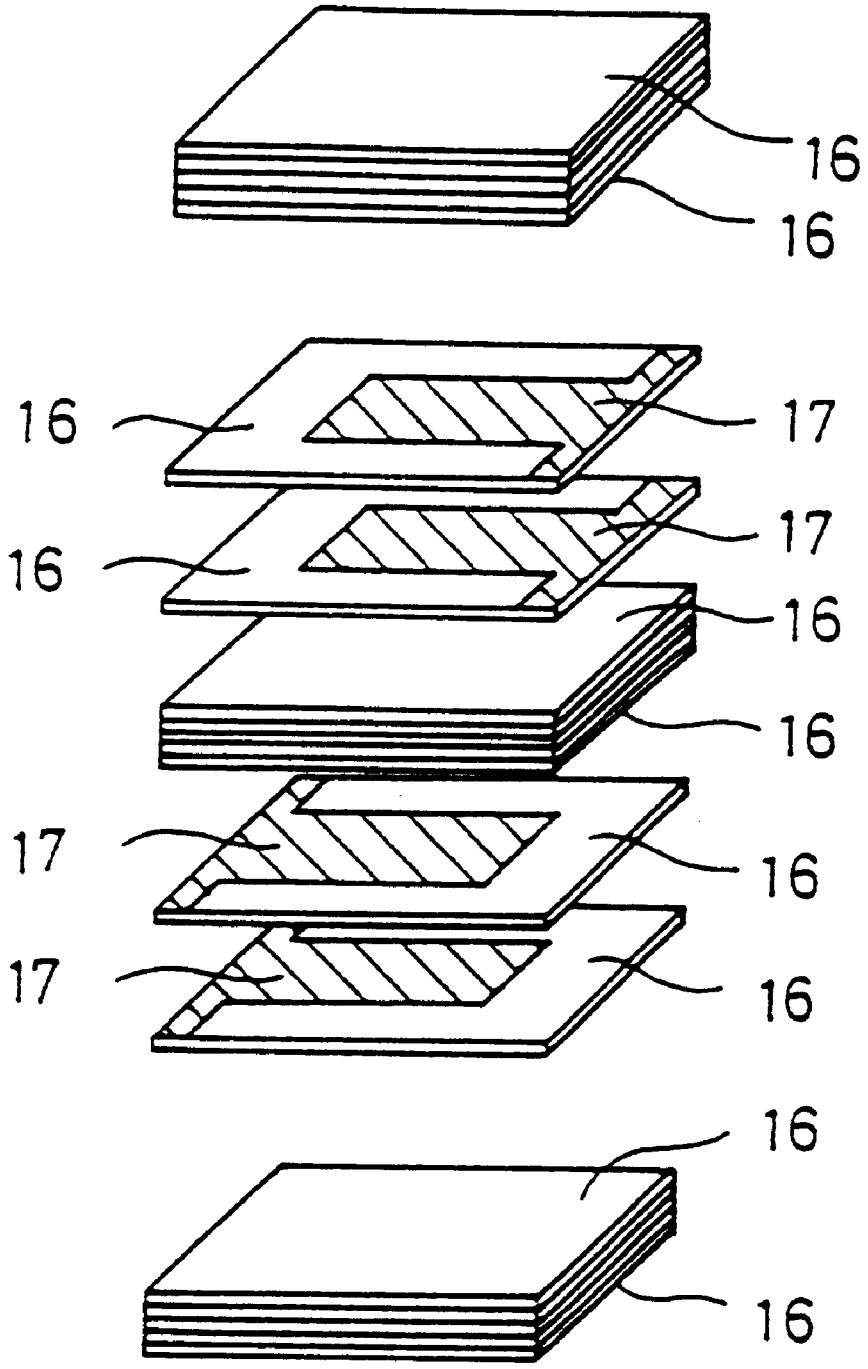
FIG. 11 is a perspective view showing arrangement of green sheets in layers in manufacture of the laminated-type varistor according to Embodiment 3.

The pattern-printed green sheets 16 as stated above are prepared as many as required, and the bare green sheets 16 are prepared as many as required. These green sheets 16 are arranged in layers in the following manner. As shown in FIG. 11, five bare green sheets 16 are arranged in layers at positions where the effective sintered body layer 3 is to be formed. Two pattern-printed green sheets 16 are arranged in layers at positions where the internal electrode 4 (5) is to be formed. As many bare green sheets 16 as required are arranged in layers at top and bottom positions where the protective layer 8 is to be formed. In this arrangement in layers, the pattern-printed green sheets 16 for the internal electrode 4 and the pattern-printed green sheets 16 for the internal electrode 5 are arranged such that pattern orientation is reversed.

Figure 12:
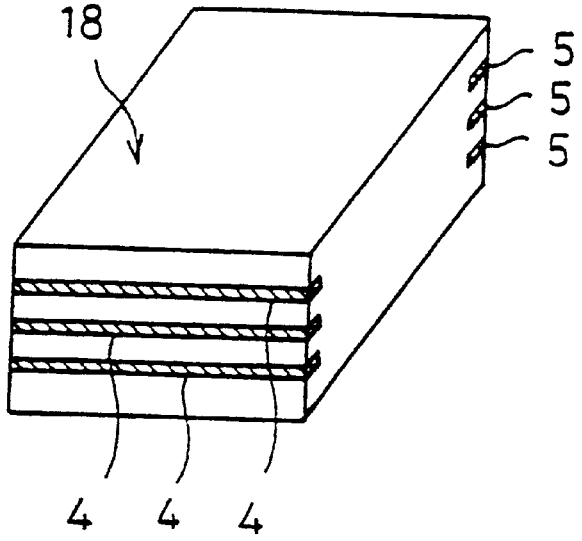
FIG. 12 is a perspective view showing a laminated structure of the laminated-type varistor according to Embodiment 3.

The thus-layered pattern-printed green sheets 16 and bare green sheets 16 are pressed under a pressure of 2 tons/$cm^2$. Subsequently, the pressed assembly is cut to obtain a laminated structure having a predetermined size, followed by heat treatment at a temperature of 500 EC for 2 hours for removing the binder. Then, the heat-treated laminated structure is fired at a temperature of 1000 EC for 3 hours, obtaining a laminated structure 18 as shown in FIG. 12. FIG. 11 shows a layered arrangement of the pattern-printed green sheets 16 for the internal electrodes 4 and 5 which constitute a single varistor element. Three of such a varistor element are laminated to obtain the laminated structure 18.

Figure 13:
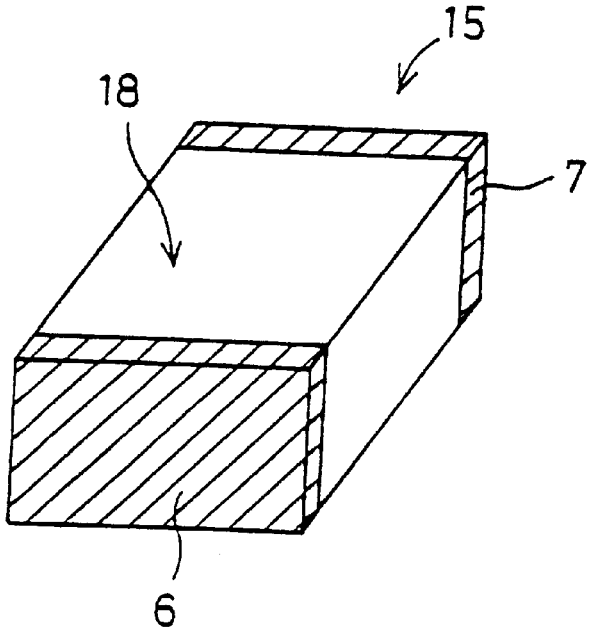
FIG. 13 is a perspective view showing the laminated-type varistor according to Embodiment 3.

Subsequently, an Ag paste, which will serve as an external electrode, is applied onto end surfaces of the obtained laminated structure 18 so as to establish electrical conductivity to the internal electrodes 4 and 5, followed by baking at a temperature of 600 EC to 800 EC. Subsequently, the Ag-coated surfaces are plated with Ni and Sn, thereby obtaining a chip-type, laminated-type varistor 15 in which the external electrodes 6 and 7 are disposed on respective end surfaces of the laminated structure 18 as shown in FIG. 13.

Figure 14:
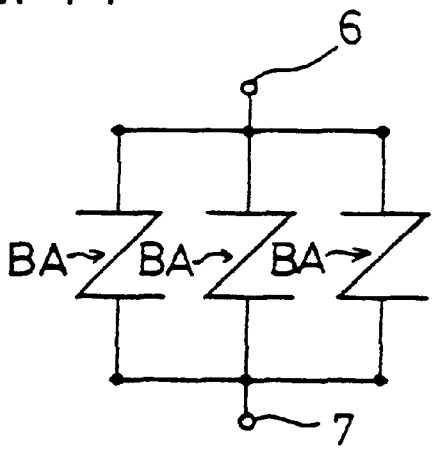
FIG. 14 is an equivalent circuit diagram of the laminated-type varistor according to Embodiment 3.

The laminated-type varistor 15 can be sursurface-mounted. FIG. 14 shows an equivalent circuit of the laminated-type varistor 15. As shown in FIG. 14, three varistor elements BA are connected in parallel.

COMPARATIVE EMBODIMENT 1

A laminated-type varistor of Comparative Embodiment 1 was manufactured in a manner similar to that of Embodiment 3 except that internal electrodes had a single-layer electrode structure as in the case of conventional laminated-type varistors.

The laminated-type varistors of Embodiment 3 and Comparative Embodiment 1 were measured for maximum peak current, maximum energy, and clamping voltage for the purpose of comparison. The measurement results are shown in FIG. 18.

In FIG. 18, the maximum peak current is a maximum current at which the rate of change in a varistor voltage is within "10% when a lightning surge current of 8/20 :S is applied to the varistor; the maximum energy is a maximum energy at which the rate of change in a varistor voltage is within "10% when a square-wave current of 2 mS is applied to the varistor; and the clamping voltage is a value as measured at a surge current of 1000 A.

As seen from FIG. 18, the laminated-type varistor of Embodiment 3 is superior to that of Comparative Embodiment 1 in any of the maximum peak current, maximum energy, and clamping voltage.

Figure 15:
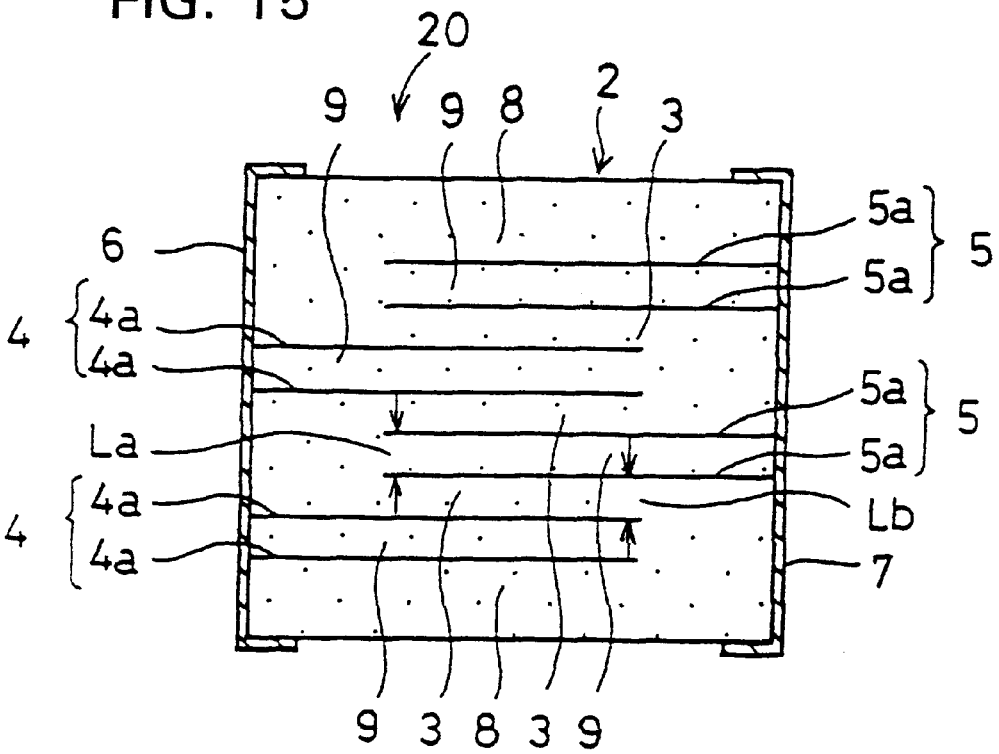
FIG. 15 is a sectional view showing a laminated-type varistor according to a modified embodiment of the present invention.

In the laminated-type varistors of the above-described embodiments, the thickness of the ineffective sintered body layer 9 is not greater than ¼ that of the effective sintered body layer 3. However, as in the case of a laminated-type varistor 20 shown in FIG. 15, a thickness La of the ineffective sintered body layer 9 may be identical to the thickness Lb of the effective sintered body layer 3. The laminated-type varistor 20 is a modified embodiment of the laminated-type varistor 1 of Embodiment 1 and yields effects similar to those of the laminated-type varistor 1. Since the laminated-type varistor 20 is configured in a manner similar to that of the laminated-type varistor 1 except for the thickness of the ineffective sintered body layer 9, the description of other features is omitted.

Figure 16:
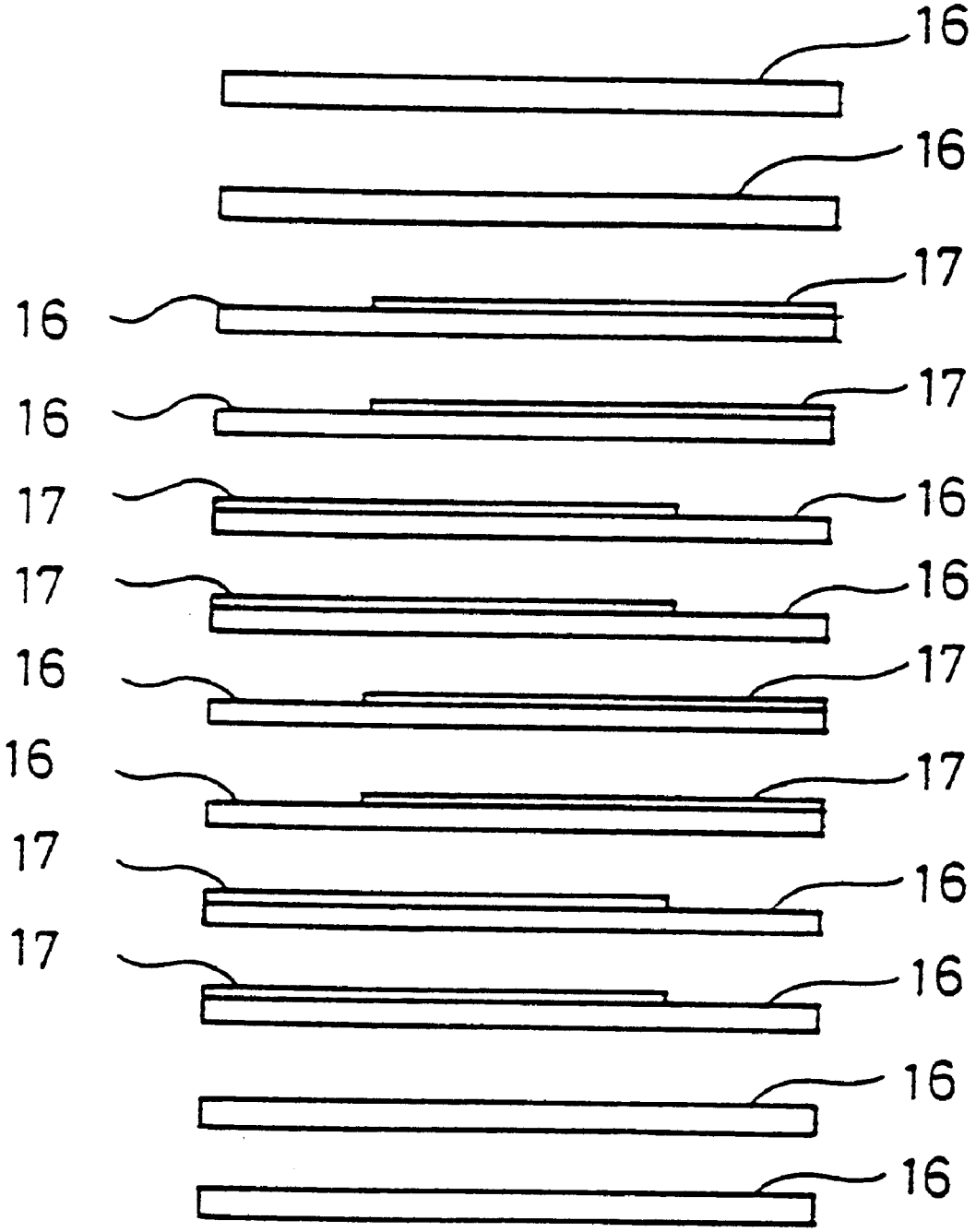
FIG. 16 is a front view showing arrangement of green sheets in layers in manufacture of the laminated-type varistor according to the modified embodiment.
Figure 17A:
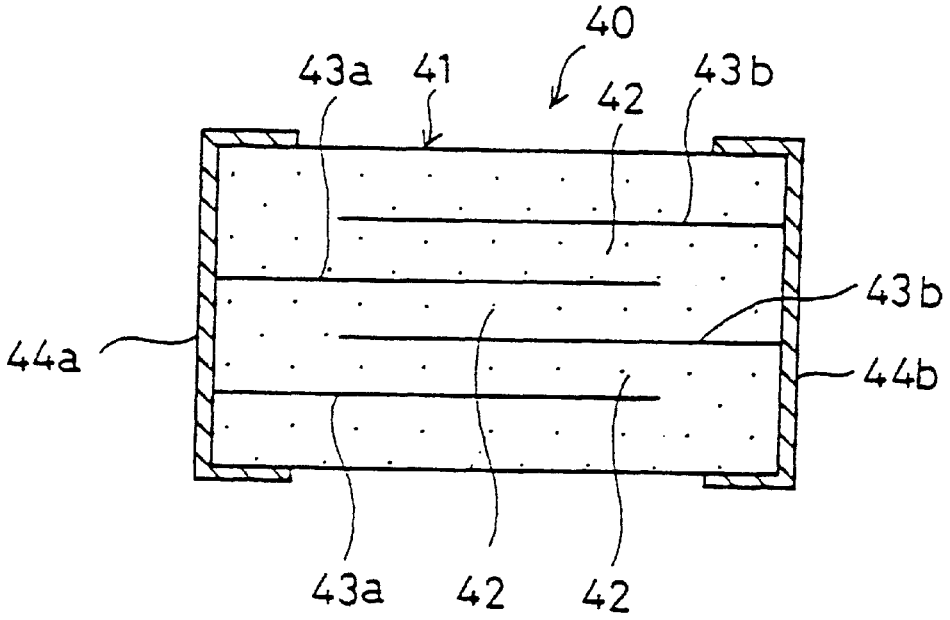
FIG. 17A PRIOR ART
FIGS. 17A and 17B are sectional views showing a conventional laminated-type varistor.
Figure 17B:
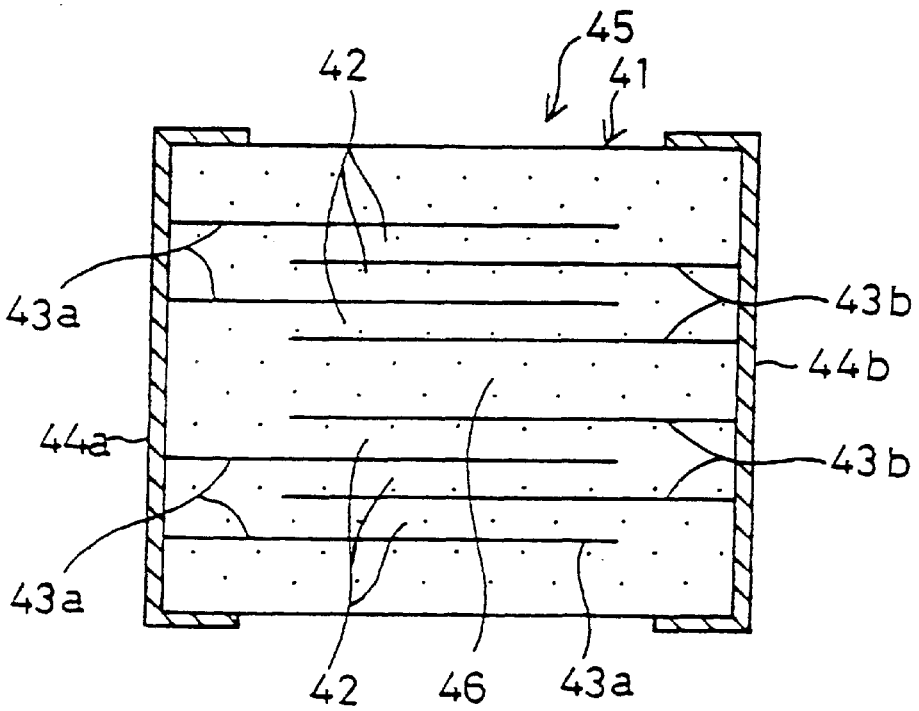
FIG. 17B PRIOR ART

In order to make the thickness of the ineffective sintered body layer 9 identical to that of the effective sintered body layer 3 as in the case of the laminated-type varistor 20, the green sheets 16 may be arranged in layers as shown in FIG. 16 in a manufacturing process. Specifically, the green sheets 16 printed with the pattern 17 are arranged in layers such that the orientation of the pattern 17 is alternatingly reversed every two of the green sheets 16. On the top and bottom of a structure of the thus-layered green sheets 16 printed with the pattern 17, there are placed the bare green sheets 16 serving as protective layers.

A method for manufacturing the laminated-type varistor of the present invention is not limited to those mentioned in the above description of the embodiments of the present invention. The laminated-type varistor of the present invention may be manufactured by other methods.

Also, the present invention is not limited to the above-described embodiments with respect to other features. Component materials of the sintered body layer, component materials of the internal electrode, and others may adopt various applied features and modifications within the scope of the present invention.

What is claimed is:

1. A laminated-type varistor comprising:

a laminated structure in which a plurality of effective sintered body layers each exhibiting varistor characteristics and a plurality of internal electrodes each having thermal conductivity higher than that of said effective sintered body layers are layered in a direction of lamination; and a pair of external electrodes disposed on a surface of said laminated structure, wherein of said plurality of internal electrodes, a plurality of adjacent pairs of said internal electrodes, each said pair being connected to a corresponding one of said external electrodes and said electrodes of each said pair being spaced apart from each other in said lamination direction, so as to define a multilayer electrode structure, wherein an ineffective sintered body layer not contributing to varistor characteristics is disposed between each said adjacent pair of internal electrodes.

2. A laminated-type varistor as described in claim 1, wherein of said plurality of internal electrodes, a top internal electrode and a bottom internal electrode each have a single-layer electrode structure.

3. A laminated-type varistor as described in claim 1 wherein one said internal electrode connected to one said external electrode and one said internal electrode connected to the other said external electrode are disposed on the same plane such that unconnected ends thereof face each other a predetermined distance away; a floating internal electrode not connected to said external electrodes is disposed apart from said internal electrodes connected to said external electrodes, via said effective sintered body layer, thus forming a multistage varistor; and said floating internal electrode is an unexposed electrode, which is not exposed on end surfaces of said laminated structure.

4. A laminated-type varistor as described in claim 1, wherein the thickness of said ineffective sintered body layer is not greater than that of said effective sintered body layers.

5. A laminated-type varistor as described in claim 1, wherein the thickness of said ineffective sintered body layer is not greater than ¼ that of said effective sintered body layers.

6. A laminated-type varistor as described in claim 2, wherein one said internal electrode connected to one said external electrode and one said internal electrode connected to the other said external electrode are disposed on the same plane such that unconnected ends thereof face each other a predetermined distance away; a floating internal electrode not connected to said external electrodes is disposed apart from said internal electrodes connected to said external electrodes, via said effective sintered body layer, thus forming a multistage varistor; and said floating internal electrode is an unexposed electrode, which is not exposed on end surfaces of said laminated structure.

7. A laminated-type varistor as described in claim 2, wherein the thickness of said ineffective sintered body layer is not greater than that of said effective sintered body layers.

8. A laminated-type varistor as described in claim 3, wherein the thickness of said ineffective sintered body layer is not greater than that of said effective sintered body layers.

9. A laminated-type varistor as described in claim 2, wherein the thickness of said ineffective sintered body layer is not greater than ¼ that of said effective sintered body layers.

10. A laminated-type varistor as described in claim 3, wherein the thickness of said ineffective sintered body layer is not greater than ¼ that of said effective sintered body layers.

11. A laminated-type varistor as described in claim 6, wherein the thickness of said ineffective sintered body layer is not greater than that of said effective sintered body layers.

12. A laminated-type varistor as described in claim 6, wherein the thickness of said ineffective sintered body layer is not greater than ¼ that of said effective sintered body layers.

13. A laminated-type varistor comprising:

a laminated structure in which a plurality of effective sintered body layers each exhibiting varistor characteristics and a plurality of internal electrodes each having thermal conductivity higher than that of said effective sintered body layer are layered in a lamination direction; and a pair of external electrodes disposed on a surface of said laminated structure, wherein of said plurality of internal electrodes, at least two of said internal electrodes connected to a corresponding one said external electrode and disposed apart from each other in said lamination direction so as to define a multilayer electrode structure with an ineffective sintered body layer not contributing to varistor characteristics disposed between said at least two internal electrodes;

wherein one said internal electrode connected to one said external electrode and one said internal electrode connected to the other said external electrode are disposed in a plane such that unconnected ends thereof face each other with a predetermined spacing; a floating internal electrode not connected to said external electrodes is disposed apart from said internal electrodes connected to said external electrodes, via said effective sintered body layer, thus forming a multistage varistor; and said floating internal electrode is an unexposed electrode, which is not exposed on end surfaces of said laminated structure.

14. A laminated-type varistor as described in claim 13, wherein the thickness of said ineffective sintered body layer is not greater than that of said effective sintered body layers.

15. A laminated-type varistor as described in claim 13, wherein the thickness of said ineffective sintered body layer is not greater than ¼ that of said effective sintered body layers.

16. A laminated-type varistor comprising:

a laminated structure in which a plurality of effective sintered body layers each exhibiting varistor characteristics and a plurality of internal electrodes each having thermal conductivity higher than that of said effective sintered body layer are layered in a lamination direction; and a pair of external electrodes disposed on a surface of said laminated structure, wherein of said plurality of internal electrodes, at least two of said internal electrodes connected to a corresponding one said external electrode and disposed apart from each other in said lamination direction so as to define a multilayer electrode structure with an ineffective sintered body layer not contributing to varistor characteristics disposed between said at least two internal electrodes;

wherein of said plurality of internal electrodes, a top internal electrode and a bottom internal electrode each have a single-layer electrode structure;

wherein one said internal electrode connected to one said external electrode and one said internal electrode connected to the other said external electrode are disposed in a plane such that unconnected ends thereof face each other with a predetermined spacing; a floating internal electrode not connected to said external electrodes is disposed apart from said internal electrodes connected to said external electrodes, via said effective sintered body layer, thus forming a multistage varistor; and said floating internal electrode is an unexposed electrode, which is not exposed on end surfaces of said laminated structure.

17. A laminated-type varistor as described in claim 16, wherein the thickness of said ineffective sintered body layer is not greater than that of said effective sintered body layers.

18. A laminated-type varistor as described in claim 16, wherein the thickness of said ineffective sintered body layer is not greater than ¼ that of said effective sintered body layers.

* * * * *